US009366048B1

(12) United States Patent
Leach

(10) Patent No.: US 9,366,048 B1
(45) Date of Patent: Jun. 14, 2016

(54) SWIMMING POOL WITH MINIMAL HEIGHT DECK INNER EDGE AND METHOD OF FORMING THE SAME

(71) Applicant: Kent Fredrick Leach, Gilbert, AZ (US)

(72) Inventor: Kent Fredrick Leach, Gilbert, AZ (US)

( * ) Notice: Subject to any disclaimer, the term of this patent is extended or adjusted under 35 U.S.C. 154(b) by 437 days.

(21) Appl. No.: 13/917,282

(22) Filed: Jun. 13, 2013

Related U.S. Application Data

(60) Provisional application No. 61/659,129, filed on Jun. 13, 2012.

(51) Int. Cl.
*E04H 4/00* (2006.01)
*E04H 4/14* (2006.01)

(52) U.S. Cl.
CPC ..... *E04H 4/14* (2013.01)

(58) Field of Classification Search
CPC ..... E04H 4/14; E04H 4/141
USPC ..... 4/490, 506
See application file for complete search history.

(56) References Cited

U.S. PATENT DOCUMENTS 3,839,748 A * 10/1974 Stillman, Jr. ..... E04H 4/142 4/506
4,189,887 A * 2/1980 Gallant ..... E04H 4/141 4/506
5,978,979 A * 11/1999 Baker ..... E04H 4/1227 4/506
2012/0321880 A1* 12/2012 Millar ..... E04H 4/14 428/319.3

* cited by examiner

*Primary Examiner* — Tuan N Nguyen
(74) *Attorney, Agent, or Firm* — Schmeiser, Olsen & Watts LLP

(57) ABSTRACT

The disclosed swimming pool includes an upslope pool deck section. The upslope pool deck section extends from the deck inner edge to a crown line, where the crown line, which is further from the water than the deck inner edge, is the high point of the upslope pool deck section. The upslope pool deck section has a surface gradient which slopes upwards in a direction away from the pool water. The deck inner edge is the low point in elevation of the upslope pool deck section. The crown line is the high point in elevation of the upslope pool deck section. This configuration of pool deck allows the water line to approach the deck inner edge without water overflowing over the deck inner edge. The pool has an appealing look similar to a zero-edge pool because the deck inner edge does not extend much higher than the water line.

10 Claims, 12 Drawing Sheets

SWIMMING POOL WITH MINIMAL HEIGHT DECK INNER EDGE AND METHOD OF FORMING THE SAME

CROSS REFERENCE TO RELATED APPLICATIONS

This application is a continuation of U.S. Patent Application No. 61/659,129 to Kent Fredrick Leach filed Jun. 13, 2012 and entitled "Minimal Edge Swimming Pool", which is incorporated entirely herein by reference.

BACKGROUND OF THE INVENTION

1. Technical Field

This invention relates generally to swimming pools and in particular to a swimming pool with a minimal height deck inner edge at the shoreline.

2. State of the Art

Swimming pools are in popular use in residential and park installations. Residential swimming pools are often constructed to add beauty and art to the landscaping, as well as to provide recreational swimming opportunities. Swimming pools often have a swimming pool deck which surrounds the outer edges of the swimming pool. Traditional swimming pool construction has the swimming pool deck sloping away from the swimming pool. Water which lands on the swimming pool deck runs away from the swimming pool in this type of traditional swimming pool deck. At the shoreline, also known as the water's edge or deck inner edge, the swimming pool deck usually rises about 6 inches above the water line. The deck inner edge in this type of construction is the high point for the pool deck. The pool deck has a downslope gradient which has a low point at the deck outer edge, the edge away from the pool. This type of pool construction is conventional, functional, and cost effective. However, the "deep" deck inner edge—a deck inner edge with a height of around 6" or more above the water line—retracts from the beauty of the pool. In addition, the height of the deck inner edge above the water line makes it difficult for swimmers to get into and out of the pool. Therefore, it is desirable to have a pool in which the pool deck transitions into the pool water with a minimally obtrusive and minimal height pool deck inner edge.

The elegant look of a zero-edge pool, or infinity pool, has become popular in higher-end pool construction. In an infinity or zero-edge pool, the water runs over the edge of the pool shell at the water's edge. This makes the pool look like it has no pool edge. Water continually runs over the pool edge, and is collected by a gutter or other water feature and is then recirculated through the filter system and back into the pool. The look of this type of pool is very elegant and appealing. But it is costly to build and maintain. Thus there is a need for a minimal edge swimming pool which has the aesthetic beauty of a zero-edge pool without the installation and maintenance cost.

DISCLOSURE OF THE INVENTION

The present invention relates to swimming pools and in particular to a swimming pool with a minimal height deck inner edge at the shoreline.

Disclosed is a swimming pool that includes a pool shell and an upslope pool deck section. The pool shell contains swimming pool water. The upslope pool deck section includes a deck inner edge and a crown line. The crown line is the outer edge of the upslope pool deck section. The upslope pool deck section extends from the deck inner edge to the crown line.

The upslope pool deck section has a surface gradient such that water runs from the crown line to the deck inner edge. The swimming pool according to the invention has an obtuse shore angle. The shore angle is the angle between the pool shell and the upslope pool deck section at the deck inner edge. In some embodiments the shore angle is an angle between 90 and 100 degrees. In some embodiments the shore angle is an angle between 90 and 95 degrees. In some embodiments the shore angle is an angle between 90 and 93 degrees. In some embodiments the shore angle is an angle between 90 and 92 degrees. In some embodiments the shore angle is about 91.2 degrees. In some embodiments the upslope pool deck section is covered with a deck coating. In some embodiments the deck coating is porous. In some embodiments the deck coating comprises rubber. In some embodiments the deck coating is an ethylene propylene diene monomer (EPDM) material. In some embodiments the swimming pool also includes a first downslope pool deck section. The first downslope pool deck section extends from the crown line to the deck outer edge. The first downslope pool deck section has a surface gradient such that water runs from the crown line to the deck outer edge. In some embodiments the swimming pool also includes a second downslope pool deck section. The second downslope pool deck section extends from the deck inner edge to the deck outer edge. The second downslope pool deck section has a surface gradient such that water runs from the deck inner edge to the deck outer edge. In some embodiments the second downslope pool deck section includes a pool skimmer. In some embodiments the swimming pool according to the invention includes a low-profile pool skimmer. In some embodiments the low-profile pool skimmer comprises a lintel, wherein the lintel comprises steel.

Disclosed is a swimming pool deck that includes a deck inner edge, an upslope pool deck section, and a crown line. The upslope pool deck section has a constant surface gradient, sloping up from a low point at the deck inner edge to a high point at the crown line, with no peaks or valleys in between. In some embodiments the upslope pool deck section includes a deck coating, where the deck coating comprises porous rubber. In some embodiments the deck inner edge has a height above a waterline of the swimming pool that is no larger than 1 inch. In some embodiments the swimming pool deck according to the invention includes a low-profile pool skimmer. In some embodiments the upslope pool deck sections further comprises a deck skimmer section above the low-profile pool skimmer. In some embodiments the deck skimmer section is flat, with no surface gradient.

Disclosed is a method of forming a swimming pool that includes the steps of forming a pool shell, where the pool shell holds swimming pool water, and forming an upslope pool deck section. In some embodiments the upslope pool deck section meets the swimming pool shell at a deck inner edge, forming an obtuse angle between the pool shell and the upslope pool deck section. In some embodiments the upslope pool deck section meets the swimming pool shell at a deck inner edge, where the upslope pool deck section extends from a low point at the deck inner edge to a high point at a crown line, with a constant surface gradient with no peaks or valleys in between the deck inner edge and the crown line. In some embodiments the method further includes the step of forming a first downslope pool deck section. In some embodiments the method further includes forming a second downslope pool deck section. In some embodiments the method includes the step of covering a portion of the upslope pool deck section with a coating. In some embodiments the coating is porous. In some embodiments the coating comprises a porous rubber material. In some embodiments the coating is an ethylene propylene diene monomer (EPDM) material. In some embodiments the method includes the step of installing a low-profile pool skimmer. In some embodiments the low-profile pool skimmer comprises a lintel. In some embodiments the lintel comprises steel. In some embodiments the low-profile pool skimmer comprises a steel lintel. In some embodiments the step of forming an upslope pool deck section includes the step of forming a level deck skimmer section. In some embodiments the step of forming an upslope pool deck section includes the step of forming a level deck skimmer section above the low-profile pool skimmer In some embodiments the step of forming an upslope pool deck section includes the step of forming a sideslope deck skimmer section alongside the level deck skimmer section.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
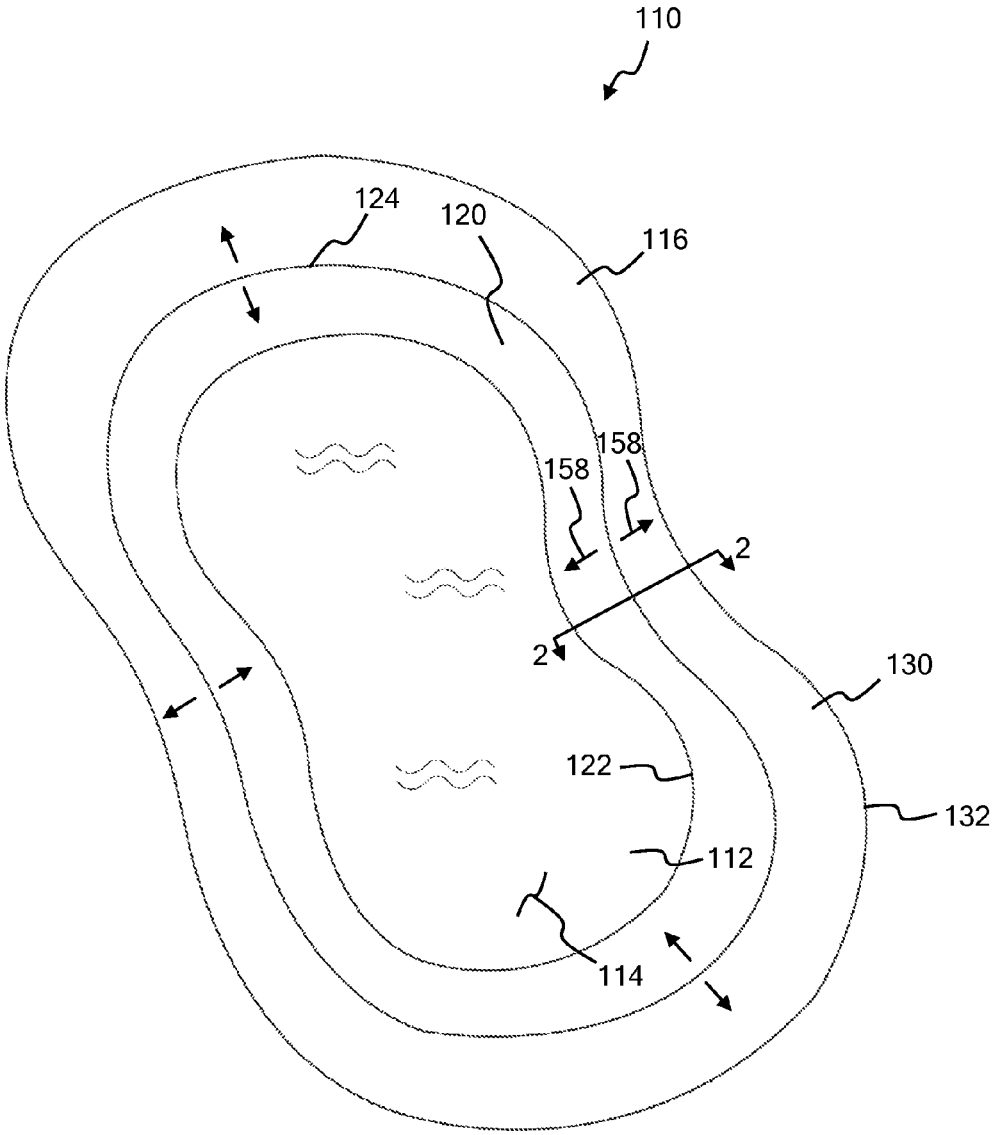
FIG. 1 is a top view of an embodiment of swimming pool 110 according to the invention.

As discussed above, embodiments of the present invention relate to swimming pools and in particular to a swimming pool with a minimal height deck inner edge at the shoreline.

Swimming pools are in common use to provide the capability for recreational swimming, pool games, or athletic swimming at either a home or a sports facility. There are different types of swimming pools, including above-ground pools and in-ground pools. This document discusses only in-ground swimming pools. Residential in-ground swimming pools are popular, and often include a pool shell surrounded by a pool deck. The pool shell of an in-ground swimming pool is inset into the ground such that the shoreline of the pool is approximately even with ground level. The pool shell holds the swimming pool water. The pool deck is a surface which covers the ground along a portion, or all, of the circumference of the pool shell. The pool deck provides a solid surface, giving strength and stability to the pool shell in the ground, a base for pool accessories such as slides and diving boards, and a solid place for swimmers to occupy along the edge of the pool.

A pool deck extends from a deck inner edge to a deck outer edge. The deck inner edge is the edge where the pool shell and the pool deck meet. The height of the deck inner edge is the height H of the deck inner edge above the waterline (see FIG. 3). A pool where the waterline flows over the deck inner edge, such as an 'infinity' pool, has a deck inner edge with zero height. A "minimal" height deck inner edge is one where the height H of the deck inner edge above the waterline approaches but does not reach zero. The slope angle is the angle between the pool deck and the pool shell at the deck inner edge, where the pool deck meets the pool shell.

The deck outer edge is the outside edge of the pool deck, where the pool deck meets the landscaping, yard, or wall area that surrounds the pool. Pool decks often have a surface gradient so that water does not puddle on the pool deck but instead runs off. A surface gradient is the slope or rate of increase or decrease in the elevation of a surface. The pool deck surface gradient is the slope or rate of increase or decrease in the elevation of the pool deck.

For swimming pools in common use today, the pool deck is a downslope pool deck where the downslope direction points away from the pool, from the deck inner edge to the deck outer edge. The disadvantage to this configuration of pool deck is that the deck inner edge is the highest point, or elevation, of the pool deck itself. This causes the deck inner edge to have a height above the water line of approximately 5 to 7 inches. The height of the deck inner edge above the swimming pool water causes the deck to have an obvious visual look to the edge, as well as creating a deck inner edge that can make it difficult for a swimmer to exit from inside the pool. The high deck inner edge is considered obtrusive. It is desirable to have a less obtrusive minimal height deck inner edge, both for visual aesthetic reasons and for ease in exiting and entering the pool water.

Zero-edge, or infinity, pools have become popular because they do not have the obtrusive high deck inner edge. In a zero-edge pool the deck inner edge is low enough that the pool water continuously runs over the deck inner edge. The water is collected and recirculated after it falls over the deck inner edge. In some zero-edge pools the water runs over the deck inner edge across a portion of the pool deck into a gutter. The gutter is the low point of the pool deck and collects the water for recirculation. The look of a zero-edge pool is elegant and leads to dramatic pool water features. However, the cost of this type of pool is high, and maintenance can be expensive also.

The swimming pool according to the invention disclosed in this document includes an upslope pool deck section. The upslope pool deck section extends from the deck inner edge to a crown line, where the crown line, which is further away from the water than the deck inner edge, is the high point of the upslope pool deck section. The upslope pool deck section has a surface gradient which slopes upwards when traveling in a direction away from the pool water. The deck inner edge is the low point in elevation of the upslope pool deck section. The crown line is the high point in elevation of the upslope pool deck section. This configuration of pool deck allows the deck inner edge to approach the water line without water overflowing over the deck inner edge. The deck inner edge is no longer obtrusive, with a several inch height above the waterline. The pool has an appealing look similar to a zero-edge pool because the deck inner edge does not extend much higher than the water line. In some embodiments the deck inner edge is about ½" above the waterline. In some embodiments the deck inner edge is about ¼" to 1" above the waterline. The upslope pool deck section slopes such that water runs towards the pool shell. This makes it easier for swimmers to enter and exit at the water's edge. In the disclosed swimming pool according to the invention there is no need for a gutter or other water collection device to capture the water that overflows from the deck inner edge as in a zero-edge pool. The swimming pool according to the invention provides an aesthetically appealing and practical swimming pool deck, at a cost less than the cost of a zero-edge pool.

Figure 2:
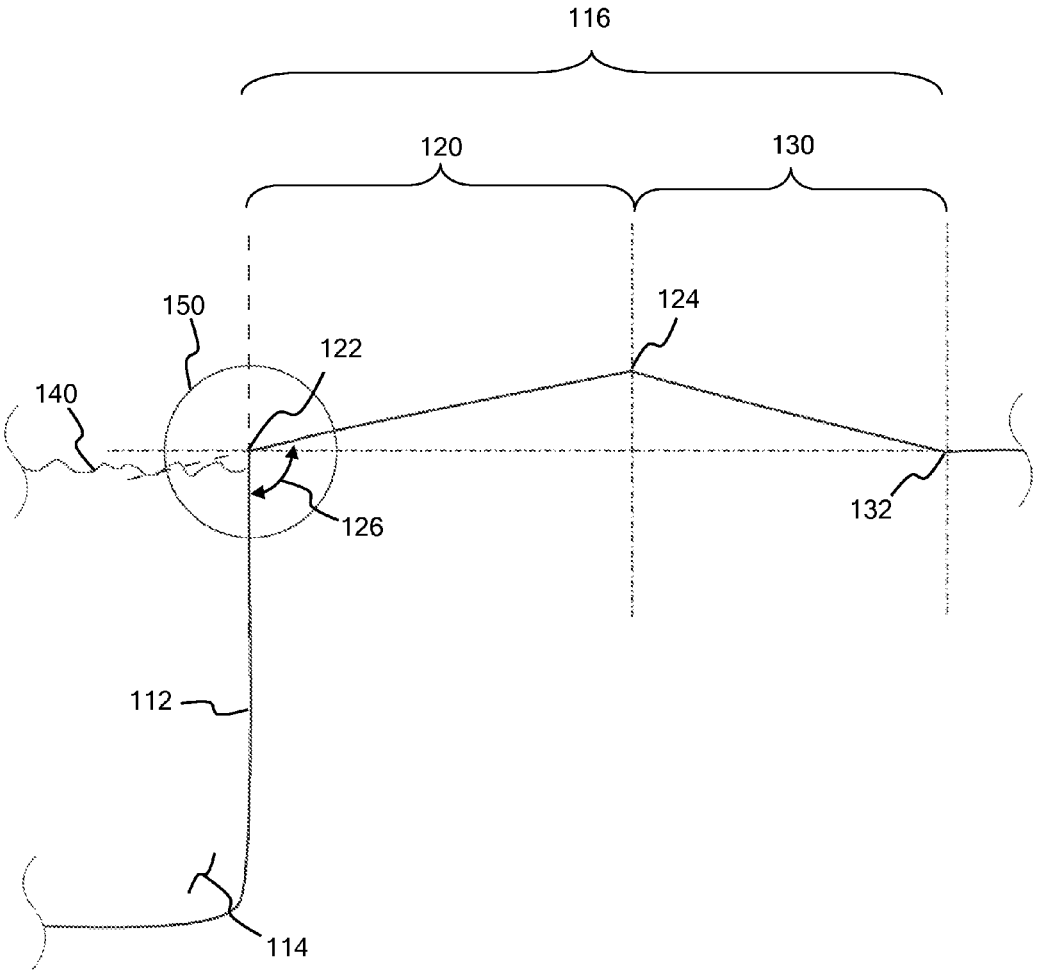
FIG. 2 is a side view cross-section of an embodiment of pool deck 116 of swimming pool 110 of FIG. 1, taken at section 2-2 of FIG. 1.
Figure 3:
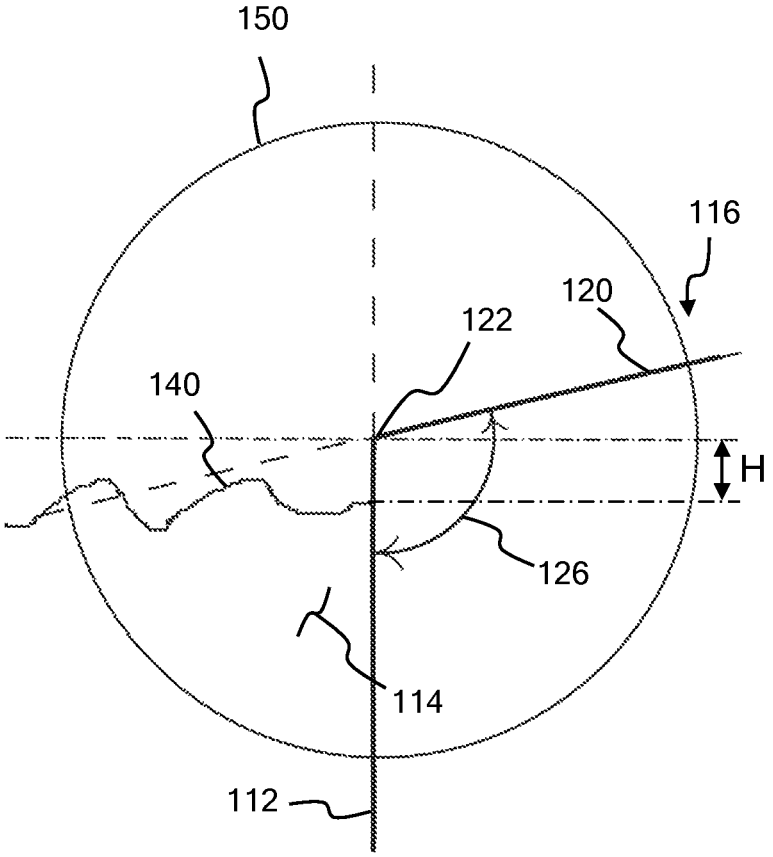
FIG. 3 shows section 150 of swimming pool deck 116 of FIG. 2, showing shore angle 126 according to the invention, which is an obtuse angle.

FIG. 1 through FIG. 3 shows an embodiment of swimming pool 110 according to the invention. FIG. 1 shows a top view of swimming pool 110 according to the invention. FIG. 2 shows a side view cross-section of pool deck 116 of swimming pool 110 taken at section 2-2 of FIG. 1. FIG. 3 shows a side view close-up of deck inner edge 122 of swimming pool 110 of FIG. 1, taken at section 150 of FIG. 2.

Swimming pool 110 according to the invention of FIG. 1 through FIG. 3 includes pool shell 112 and pool deck 116. Pool shell 112 holds swimming pool water 114. Pool deck 116 in this embodiment includes upslope pool deck section 120 according to the invention, and downslope pool deck section 130. Pool shell 112 meets upslope pool deck section 120 at deck inner edge 122, as can be seen in FIG. 1, FIG. 2, and FIG. 3. In a traditional swimming pool the deck inner edge juts above the waterline, as discussed earlier, but in the pool shown in FIG. 1 through FIG. 3, deck inner edge 122 is only slightly above waterline 140.

Upslope pool deck section 120 extends from deck inner edge 122 to crown line 124. Downslope pool deck section 130 extends from crown line 124 to deck outer edge 132. Crown line 124 is the outer edge of upslope pool deck section 120. Crown line 124 is also the high point—the highest point in surface elevation—of upslope pool deck section 120, and of pool deck 116 in this embodiment. Upslope pool deck section 120 has a surface gradient such that water runs from crown line 124 to deck inner edge 122. Downslope pool deck section 130 has a surface gradient such that water runs from crown line 124 to deck outer edge 132. These surface gradients are indicated by elevation indicator arrows 158. Elevation indication arrows 158 are used to indicate the surface gradient of a surface. Elevation indication arrows 158 point in the direction that water flows, which is from the higher elevation to the lower elevation. Elevation indication arrows 158 are shown in the figures in this document, although not all the elevation arrows are numbered, in order to avoid figure congestion.

FIG. 2 shows a cross section of pool deck 116 of FIG. 1, showing that crown line 124 is the highest point in the elevation of upslope pool deck section 120 and pool deck 116. It is to be understood that the surface gradient of upslope pool deck section 120 and downslope pool deck section 130 have been exaggerated in FIG. 2, FIG. 3, and FIG. 4 (to be discussed shortly) in order to clearly show the surface gradients involved. In many embodiments the surface gradients are such that the elevation changes at a rate of about ¼" of elevation per one foot of pool deck radius. This slow rate of change of elevation would be difficult to visually discern if drawn to scale in the figures.

Upslope pool deck section 120 in this embodiment has a constant surface gradient, sloping up from a low point at deck inner edge 122 to a high point at crown 124, with no peaks or valleys in between. A low point is the point on a surface of interest which has the lowest elevation. A high point is the point on a surface of interest which has the highest elevation. Dips or valleys are intermediate low points, which are lower in elevation than the nearby deck area, but not necessarily lower in elevation than the low point. Peaks are relative high points, which are higher in elevation than the nearby deck area, but no necessarily higher than the high point. Upslope pool deck section 120 has no dips, valleys, low points or gutters to collect water in between the deck inner edge and the crown line. This provides a constant surface gradient upslope pool deck section that rises elegantly from the water's edge similar to the shore of a natural body of water. Deck inner edge 122 does not have an intrusively high height H above waterline 140, but instead meets pool shell 112 very close to water line 140, as shown in FIG. 2 and FIG. 3. In this embodiment deck inner edge 122 has a height H of about ½ inch above waterline 140. In some embodiments deck inner edge 122 has a height H of no larger than 1 inch above waterline 140. In some embodiments deck inner edge 122 has a height H of less than or equal to 2 inches above waterline 140. The look of swimming pool 110 is aesthetically appealing, and the pool is easier for swimmers to enter and exit at deck inner edge 122.

Because upslope pool deck section 120 has a surface gradient with a low point at deck inner edge 122 and a high point at crown line 124, upslope pool deck section 120 forms an obtuse shore angle at deck inner edge 122. An obtuse angle is an angle between 90 and 180 degrees. Obtuse shore angle 126 can be seen in FIG. 2 and FIG. 3. FIG. 3 shows an expanded view of section 150 of FIG. 2, showing deck inner edge 122, and shore angle 126. Shore angle 126 is the angle between pool shell 112 and upslope pool deck section 120 at deck inner edge 122. Pool shell 112 is often a vertical surface, or a near vertical surface. Upslope pool deck section 120 is a surface with a low point at deck inner edge 122, and an "upslope" surface gradient—an increasing surface elevation traveling from deck inner edge 122 to crown line 124. Because upslope pool deck section 120 has a low point at deck inner edge 122 and a high point at crown line 124, shore angle 126 is an obtuse angle.

In traditional pool deck construction, shore angle 126 is an angle less than 90 degrees, because the pool deck has a high point at the deck inner edge, and the pool deck slopes away from the deck inner edge, with a surface elevation decreasing in a direction from the deck inner edge to the deck outer edge.

Swimming pool 110 according to the invention as shown in FIG. 1 through FIG. 3 has a shore angle 126 that is an obtuse angle. In some embodiments shore angle 126 is between 90 and 100 degrees. In some embodiments the shore angle is an angle between 90 and 95 degrees. In some embodiments the shore angle is an angle between 90 and 93 degrees. In some embodiments the shore angle is an angle between 90 and 92 degrees. In some embodiments the shore angle is approximately 91.2 degrees.

Figure 4:
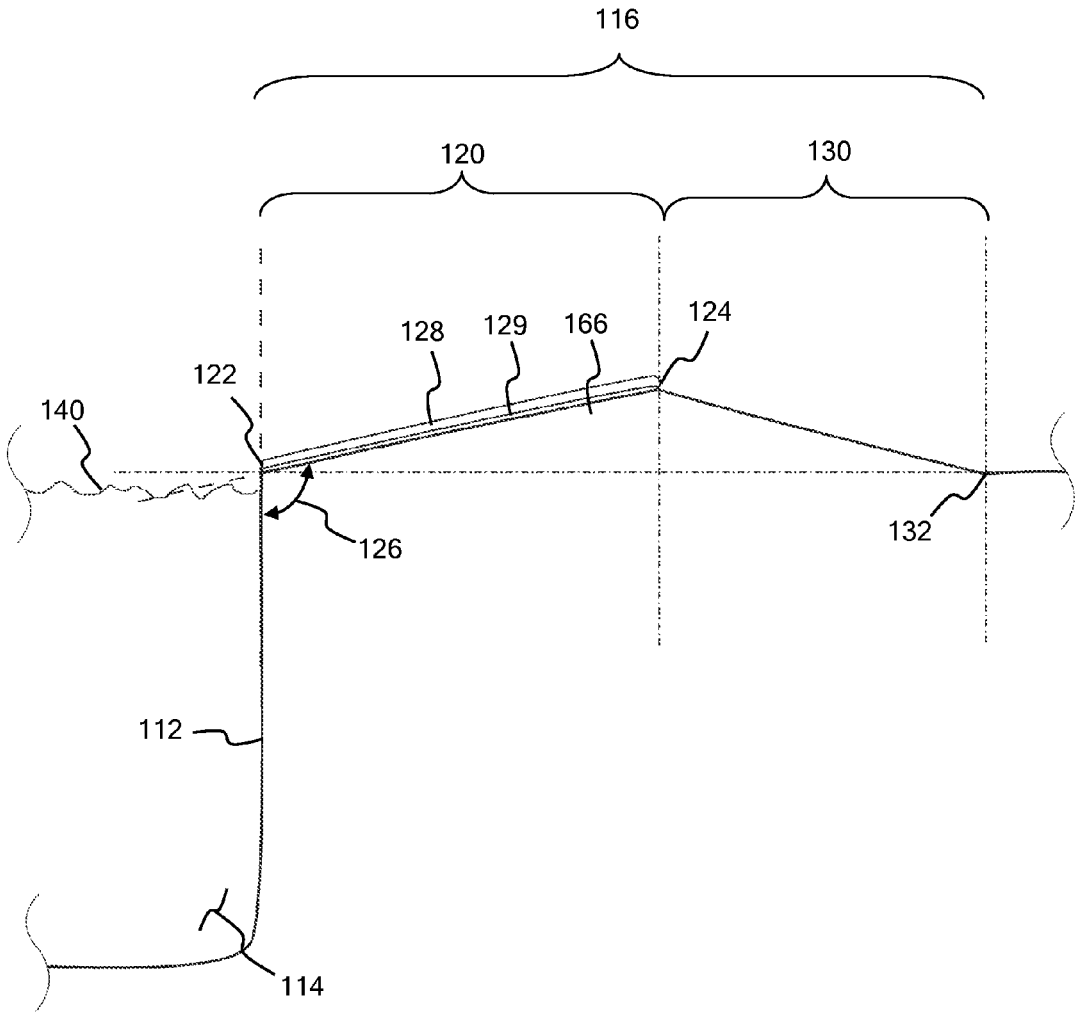
FIG. 4 is a side view cross-section of another embodiment of pool deck 116 according to the invention of swimming pool 110 of FIG. 1, where upslope pool deck section 120 includes coating 128.

In some embodiments of swimming pool 110 and pool deck 116 according to the invention, upslope pool deck section 120 includes deck coating 128. Deck coating 128 covers all or a portion of upslope pool deck section 120, as shown in one embodiment in FIG. 4. FIG. 4 shows a cross section of an embodiment of pool deck 116 of FIG. 1 taken at section 2-2, with upslope pool deck section 120 covered with deck coating 128. In the embodiment shown in FIG. 4, upslope pool deck section 120 includes deck coating 128 and waterproofing layer 129. In this embodiment upslope pool deck section 120 includes shotcrete 166 covered with waterproofing layer 129, which is covered with deck coating 128. In some embodiments deck coating 128 is a rubber material. In some embodiments deck coating 128 is a porous rubber material. In some embodiments deck coating 128 is an ethylene propylene diene monomer (EPDM) material. In some embodiments deck coating 128 is porous so that water that is incident on upslope pool deck section 120 seeps through deck coating 128 to waterproofing layer 129, then runs down to deck inner edge 122 back into water 114 in pool shell 112. Using a porous substance for deck coating 128 provides a surface that imitates sand, in that water seeps below the surface and then runs back to the shoreline (deck inner edge 122) instead of running along the top surface of upslope pool deck section 120. This adds to the natural look and feel of upslope pool deck section 120, imitating the shoreline of a natural body of water. Having a porous rubber deck coating surface also contributes non-slip characteristics to deck 116.

It is to be understood that deck coating 128 is an optional element of swimming pool 110 according to the invention. In some embodiments of swimming pool 110 according to the invention, deck coating 128 is not used. In some embodiments waterproof liner 129 is not used. In some embodiments deck coating 128 is tile. In some embodiments deck coating 128 is travertine tile. In some embodiments deck coating 128 is another material. In some embodiments deck coating 128 covers all of pool deck 116. In some embodiments deck coating 128 covers a portion of pool deck 116.

Figure 5:
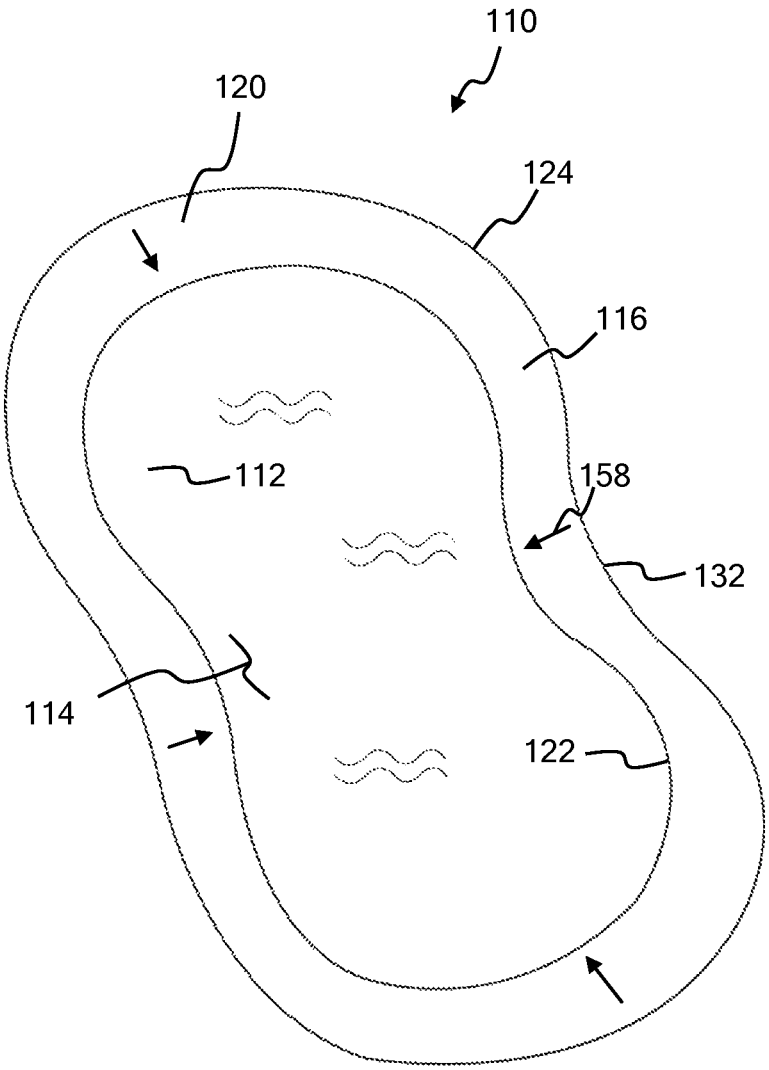
FIG. 5 is a top view of another embodiment of swimming pool 110 according to the invention. In this embodiment swimming pool 110 does not include a downslope pool deck section.

In the embodiment of swimming pool 110 according to the invention shown in FIG. 1, swimming pool 110 according to the invention includes upslope pool deck section 120, and downslope pool deck section 130. In some embodiments swimming pool 110 according to the invention does not include downslope pool deck section 130. FIG. 5 shows a top view of an embodiment of swimming pool 110 according to the invention where swimming pool 110 includes upslope pool deck section 120, but no downslope pool deck section 130. In this embodiment upslope pool deck section 120 extends from deck inner edge 122 to crown line 124. Crown line 124 in this embodiment is also deck outer edge 132, because pool deck 116 in this embodiment ends at crown line 124. Crown line 124 can be where yard landscaping begins, or where a wall or ledge begins. Deck outer edge 132 can take many other configurations.

In the embodiment of swimming pool 110 according to the invention shown in FIG. 1 and FIG. 5, swimming pool 110 includes upslope pool deck section 120, where upslope pool deck section 120 encircles pool shell 112, running along the entire circumference of pool shell 112. It is to be understood that upslope pool deck section 120 according to the invention can run along any part or portion of the circumference of pool shell 112, and does not always extend along the entire circumference of pool shell 112. In some embodiments upslope pool deck section 120 according to the invention extends along a portion of the circumference of pool shell 112. In some embodiments upslope pool deck section 120 extends along the entire circumference of pool shell 112.

Figure 6:
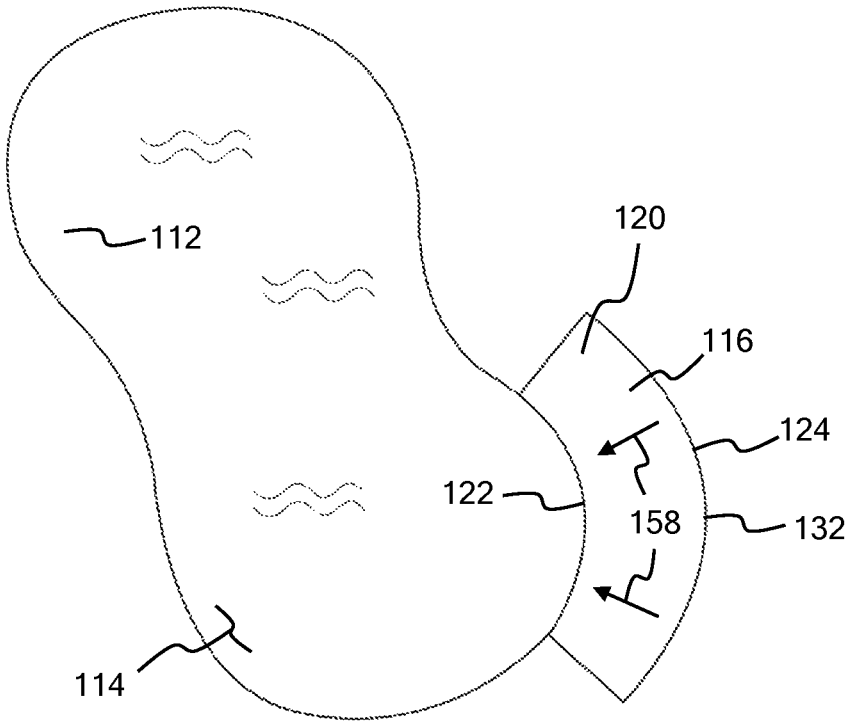
FIG. 6 is a top view of a further embodiment of swimming pool 110 according to the invention. In this embodiment upslope pool deck section 120 according to the invention covers only a portion of the circumference of pool shell 112.

FIG. 6 shows a top view of a further embodiment of swimming pool 110 according to the invention, where swimming pool 110 includes pool deck 116 extending along a portion of the circumference of pool shell 112. Pool deck 116 includes upslope pool deck section 120. In this embodiment pool deck 116 does not include a downslope pool deck section. In this embodiment upslope pool deck section 120 does not extend along the entire circumference of pool shell 112. Upslope pool deck section 120 extends along a portion of the circumference of pool shell 112. Upslope pool deck section 120 extends from deck inner edge 122 to crown line 124. Crown line 124 is also deck outer edge 132 in this embodiment. Upslope pool deck section 120 has a surface gradient such that water runs from crown line 124 to deck inner edge 122. Upslope pool deck section 120 in this embodiment has a constant surface gradient, with an elevation having a low point at deck inner edge 122 and a high point at crown line 124, sloping up from the low point to the high point with no peaks or valleys in between deck inner edge 122 and crown line 124.

Figure 7:
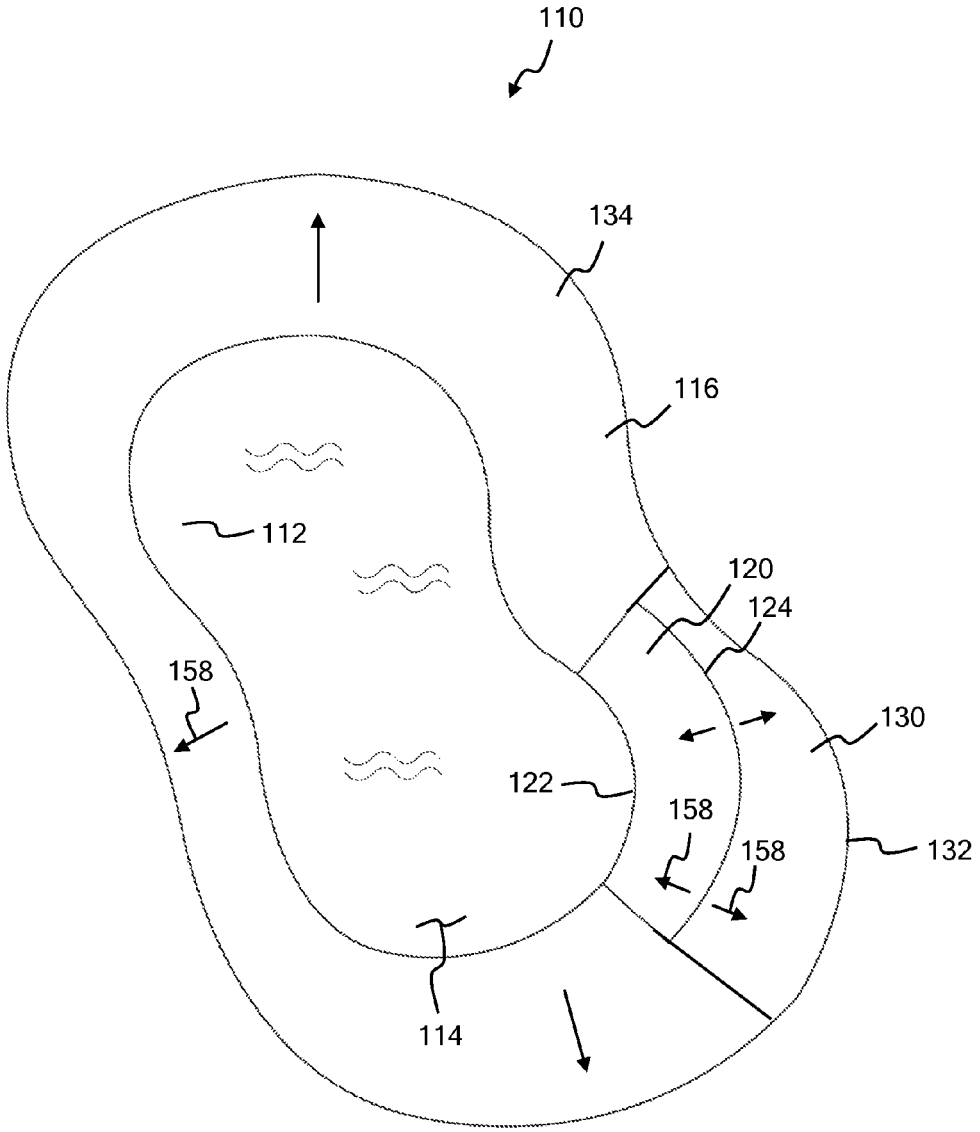
FIG. 7 is a top view of another embodiment of swimming pool 110 according to the invention, where swimming pool 110 includes upslope pool deck section 120 according to the invention, first downslope pool deck section 130, and second downslope pool deck section 134.

FIG. 7 shows a top view of an embodiment of swimming pool 110 according to the invention where pool deck 116 includes upslope pool deck section 120, first downslope pool deck section 130, and second downslope pool deck section 134. Upslope pool deck section 120 extends along a portion of the circumference of pool shell 112. Upslope pool deck section 120 extends from deck inner edge 122 to crown line 124, along a portion of the circumference of pool shell 112. First downslope pool deck section 130 extends from crown line 124 to deck outer edge 132 along crown line 124 of upslope pool deck section 120. Second downslope pool deck section 134 runs along the circumference of pool shell 112 that is not covered by upslope pool deck section 120. Second downslope pool deck section 134 extends from deck inner edge 122 to deck outer edge 134. Both first and second downslope pool deck sections 130 and 134 have a surface gradient such that water runs away from deck inner edge 122 towards deck outer edge 132. Upslope pool deck section 120 has a surface gradient such that water runs from crown line 124 to deck inner edge 122.

Figure 8:
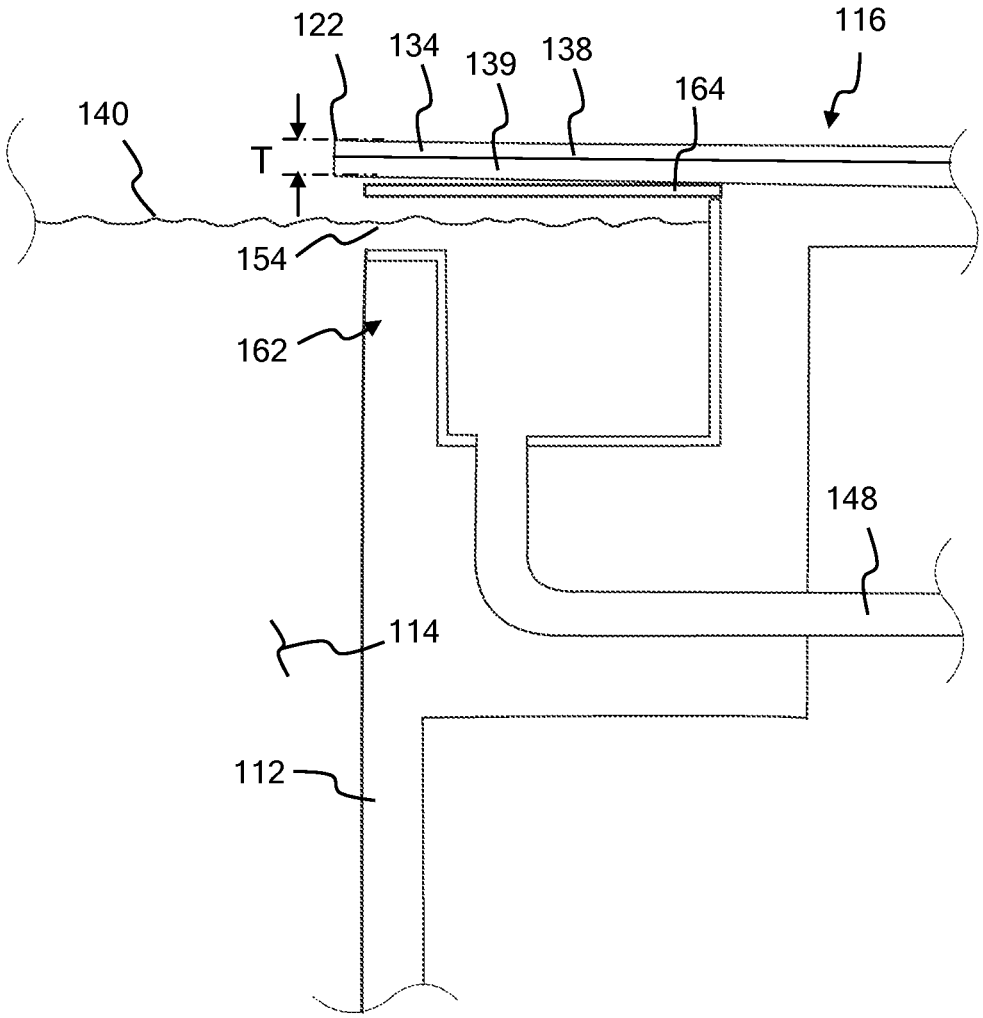
FIG. 8 Prior Art
FIG. 8 is a side view cross-section of a standard installation pool skimmer 162.

In some embodiments swimming pool 110 according to the invention includes a pool skimmer. A pool skimmer collects pool water 114 at waterline 140 of swimming pool 110 using suction, often sending pool water 114 through a filter system before recirculating pool water 114 back into pool shell 112. FIG. 8 shows a side view cross section of a standard skimmer 162 in use today in swimming pools. In this figure pool deck 116 is second downslope pool deck section 134 as shown in FIG. 7. Pool deck 116 is sloped away from pool shell 122, with deck inner edge 122 being the high point of pool deck 116. Deck inner edge 122 is about 6 inches above water line 140 in this embodiment. Pool skimmer 162 sits below pool deck 116. Skimmer top 164 is usually made of plastic and often sits a couple inches above waterline 140. Water 114 enters pool skimmer throat 154 in response to suction on suction tube 148, and then travels from skimmer 162 to a filter and/or recirculating system through suction tube 148.

Pool deck 116 above skimmer 162 needs to be able to hold the weight of people walking over pool deck 116 above skimmer 162. Standard skimmer top 164 is not strong enough to hold this weight because it is not made of a strong material. Thus, in a standard construction as shown in FIG. 8, pool deck 116 above skimmer 162 includes a layer of shotcrete 139 covered by deck coating 138. Shotcrete 139 needs to be thick enough to handle the weight of people walking over skimmer 162. The thickness T of shotcrete 139 plus deck coating 138 is often 2 inches or more. Thus deck inner edge 122 ends up at least 5 or 6 inches above waterline 140. This works when skimmer 162 is used under downslope pool deck section 134 as shown in FIG. 8. A standard skimmer 162 can be used where it is OK to have deck inner edge 122 at least about 5 or 6 inches above waterline 140. In embodiments of swimming pool 110 that include second downslope pool deck section 134, such as that shown in FIG. 8, standard skimmer 162 can be used under second downslope pool deck section 134.

However, standard skimmer 162 as shown in FIG. 8 does not fit under upslope pool deck section 120 according to the invention. Deck inner edge 122 and the surface of upslope pool deck section 120 are too close to waterline 140 to fit standard skimmer 162 as shown in FIG. 8 and still make deck 116 above skimmer 162 thick enough to hold the weight of people walking over deck 116 above skimmer 162.

Figure 9:
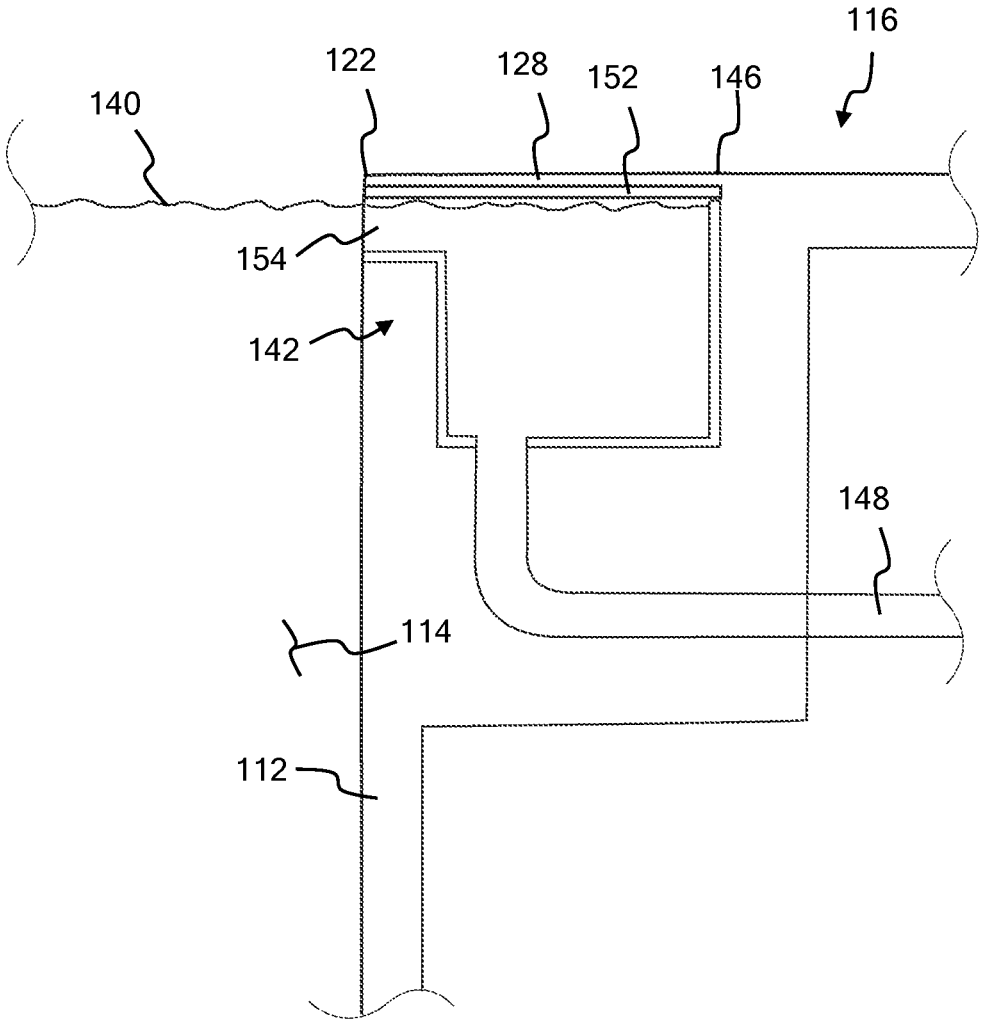
FIG. 9 is a side view cross-section of an embodiment of low profile pool skimmer 142 according to the invention.

FIG. 9 shows low-profile pool skimmer 142 according to the invention, developed to be installed with upslope pool deck section 220 according to the invention. Deck skimmer section 220 is used with low-profile pool skimmer 142 and includes deck skimmer sections 146 and 156 above low-profile pool skimmer 142. Low-profile pool skimmer 142 is configured to be place below pool deck 116 without causing deck inner edge 122 to have a height above waterline 140 of more than about 1 inch. Upslope pool deck section 220 is similar to upslope pool deck section 120 as explained earlier, except that upslope pool deck section 220 includes deck skimmer sections 146 and 156 as explained below. Low-profile skimmer 142 uses lintel 152 as the top of low-profile skimmer 152. Lintel 152 is made of very strong material to withstand the weight of people walking across deck 116 above low-profile skimmer 142. In some embodiments lintel 152 comprises steel. In some embodiments lintel 152 is steel. Lintel 152 is able to handle the weight of deck 116 and people on deck 116 without needing a layer of shotcrete or other deck underlay material above it. Deck coating 128 can be applied directly onto top of lintel 152. This allows deck inner edge to sit just slightly higher above waterline 140 than what is shown in FIG. 1 through FIG. 3. In the embodiment shown in FIG. 9, lintel 152 sits about ½ inch above waterline 140, and deck inner edge 122 sits about ¾ to 1 inch above waterline 140.

Figure 10:
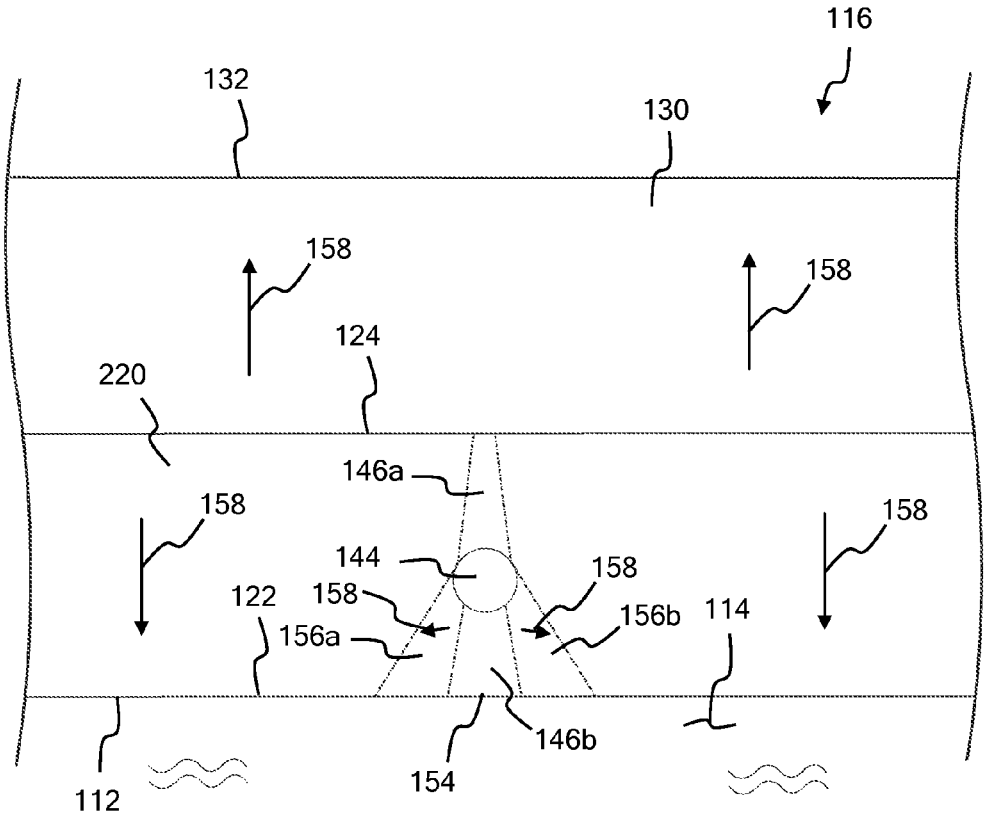
FIG. 10 shows a top view of a section of pool deck 116 of an embodiment of swimming pool 110 according to the invention, including upslope pool deck section 220, and first downslope pool deck section 130, and showing how in this embodiment there are two level pool deck sections **146*a* and 146*b* above low-profile skimmer 142 in upslope pool deck section 220**.

Because low-profile skimmer 142 raises deck inner edge 122 in some embodiments more than ½" above waterline 122, the surface gradient of upslope deck section 220 can be different above low-profile skimmer 142 than what is shown in FIG. 1 through FIG. 7. FIG. 10 shows a portion of an embodiment of deck 116 according to the invention, where deck 116 includes downslope deck section 130, and upslope pool deck section 220 according to the invention Low-profile skimmer 142 according to the invention of FIG. 9 is below skimmer lid 144 in FIG. 10. Upslope pool deck section 220 in this embodiment includes deck skimmer sections 146 and 156. Deck skimmer section 146 in this embodiment is level deck skimmer section 146 and has a flat elevation—no surface gradient or changes in elevation. Deck skimmer section 146 in this embodiment includes level deck skimmer sections **146*a* and 146*b*. In this embodiment one level deck skimmer section 146*a* is between crown line 124 and skimmer lid 144, and one level deck skimmer section 146*b* is between skimmer lid 144 and deck inner edge 122. Deck skimmer sections 146** have a flat or substantially flat elevation, with no intentional surface gradient or elevational changes (within margin of error of constructing deck surfaces).

The embodiment of upslope pool deck section 220 shown in FIG. 10 also includes deck skimmer sections 156. Deck skimmer sections 156 in this embodiment are sideslope deck skimmer sections. Sideslope deck skimmer sections **156*a* and 156*b* are alongside level deck skimmer section 146*b*. Sideslope deck skimmer sections 156 have a surface gradient such that water runs to the side onto the upslope portions of upslope pool deck section 220. As indicated by the elevational arrows 158 in FIG. 10, downslope pool deck section 130 has a high point at crown line 124, and a low point at deck outer edge 132, so that water runs from crown 124 to deck outer edge 132. Above low-profile skimmer 162, upslope pool deck section 220 has two level deck skimmer sections 146*a* and 146*b*, which have no elevational changes or surface gradients. Sideslope deck skimmer sections 156*a* and 156*b* have a surface gradient such that water runs sideways. The remainder of upslope pool deck section 220 has a low point at deck inner edge 122, and a high point at crown line 124, such that water runs from crown line 124 to deck inner edge 122**.

Figure 11:
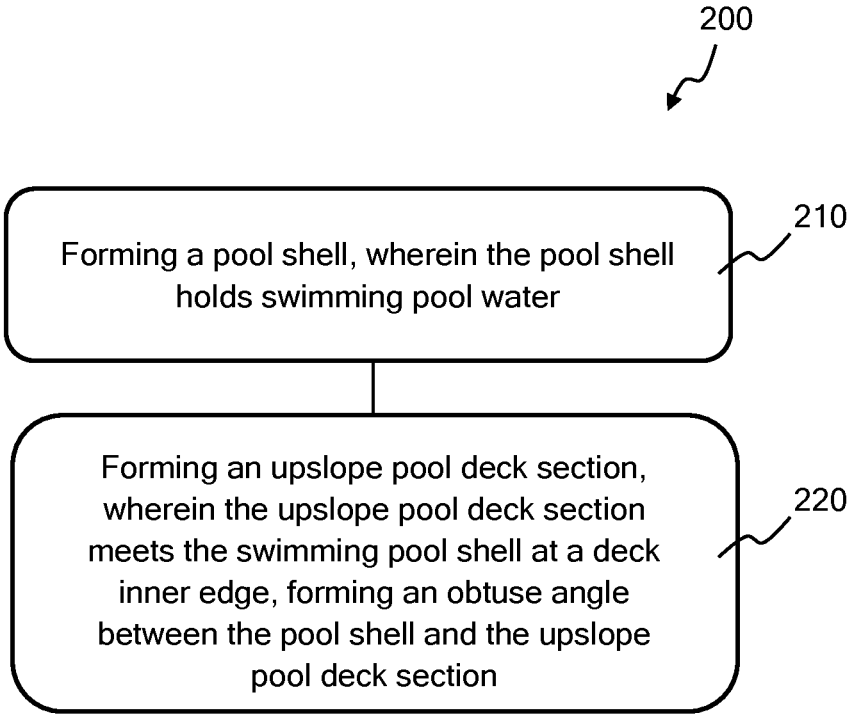
FIG. 11 shows method 200 of forming a swimming pool according to the invention.

FIG. 11 shows method 200 of forming a swimming pool according to the invention. Method 200 includes step 210 of forming a pool shell, where the pool shell holds swimming pool water. Method 200 of forming a swimming pool according to the invention also includes step 220 of forming an upslope pool deck section, where the upslope pool deck section meets the swimming pool shell at a deck inner edge, forming an obtuse angle between the pool shell and the upslope pool deck section. Method 200 can include many other steps. In some embodiments method 200 includes the step of installing a low-profile pool skimmer. In some embodiments method 200 includes the step of covering a portion of the upslope pool deck section with a deck coating. In some embodiments the deck coating is an EPDM material. In some embodiments the deck coating is a porous material. In some embodiments method 200 includes the step of forming a first downslope pool deck section, where the first downslope pool deck section extends from a crown line to a deck outer edge, and has a surface gradient such that water runs off of first downslope pool deck section away from the pool shell, towards the deck outer edge. In some embodiments method 200 includes the step of forming a second downslope pool deck section, where the second downslope pool deck section extends from a deck inner edge to a deck outer edge, and has a surface gradient such that water runs off of first downslope pool deck section away from the deck inner edge towards the deck outer edge.

Figure 12:
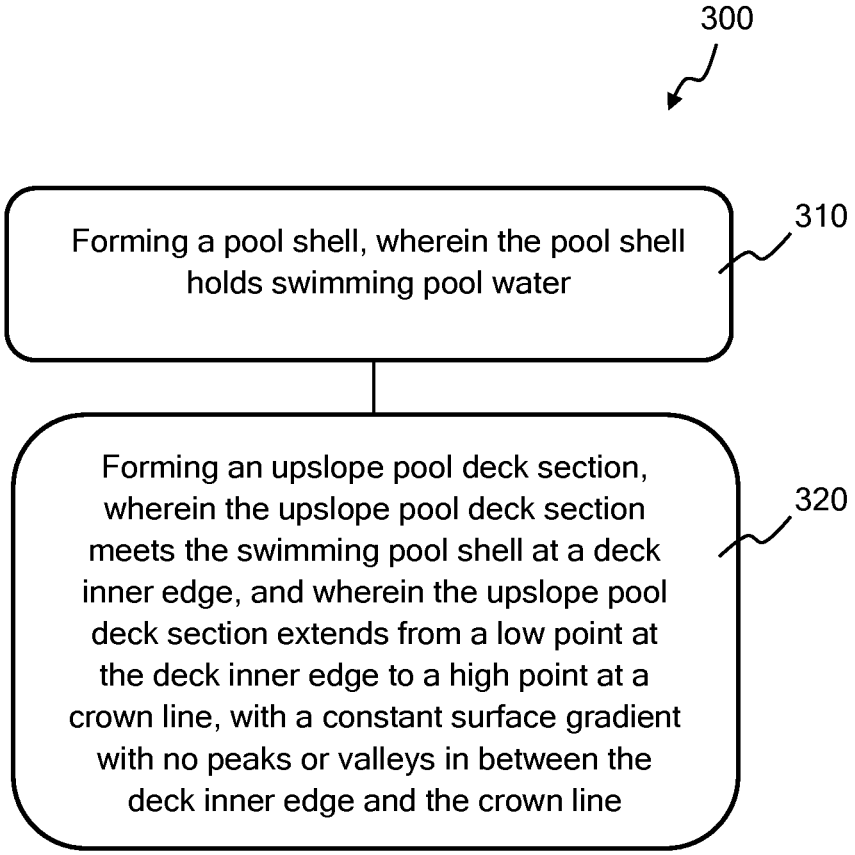
FIG. 12 shows method 300 of forming a swimming pool according to the invention.

FIG. 12 shows method 300 of forming a swimming pool according to the invention. Method 300 includes step 310 of forming a pool shell, where the pool shell holds swimming pool water. Method 300 of forming a swimming pool according to the invention also includes step 320 of forming an upslope pool deck section, where the upslope pool deck section meets the swimming pool shell at a deck inner edge, and where the upslope pool deck section extends from a low point at the deck inner edge to a high point at a crown line, with a constant surface gradient with no peaks or valleys in between the deck inner edge and the crown line. Method 300 can include many other steps. In some embodiments method 300 includes the step of installing a low-profile pool skimmer. In some embodiments method 300 includes the step of covering a portion of the upslope pool deck section with a deck coating. In some embodiments the deck coating is an EPDM material. In some embodiments the deck coating is a porous material. In some embodiments method 300 includes the step of forming a first downslope pool deck section, where the first downslope pool deck section extends from a crown line to a deck outer edge, and has a surface gradient such that water runs off of first downslope pool deck section away from the pool shell, towards the deck outer edge. In some embodiments method 300 includes the step of forming a second downslope pool deck section, where the second downslope pool deck section extends from a deck inner edge to a deck outer edge, and has a surface gradient such that water runs off of first downslope pool deck section away from the deck inner edge towards the deck outer edge.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A swimming pool comprising:

a pool shell, wherein the pool shell contains pool water;

an upslope pool deck section;

a shore angle, wherein the shore angle is the angle between the pool shell and the upslope pool deck section at the deck inner edge, wherein the shore angle is an obtuse angle, wherein the upslope pool deck section extends from a deck inner edge to a crown line, and wherein the upslope pool deck section has a surface gradient such that water runs from the crown line to the deck inner edge;

a first downslope pool deck section, wherein the first downslope pool deck section extends from the crown line to a deck outer edge, and wherein the first downslope pool deck section has a surface gradient such that water runs from the crown line to the deck outer edge; and a second downslope pool deck section, wherein the second downslope pool deck section extends from the deck inner edge to the deck outer edge, and wherein the second downslope pool deck section has a surface gradient such that water runs from the deck inner edge to the deck outer edge.

2. The swimming pool of claim 1, wherein the shore angle is between 90 and 95 degrees.

3. The swimming pool of claim 1, wherein the shore angle is between 90 and 92 degrees.

4. The swimming pool of claim 1, wherein the upslope pool deck section is covered with a deck coating, wherein the deck coating comprises rubber.

5. The swimming pool of claim 1, wherein the upslope pool deck section is covered with a deck coating, wherein the deck coating is porous.

6. The swimming pool of claim 1, further comprising a low-profile pool skimmer, wherein the low-profile pool skimmer comprises a lintel, and wherein the lintel comprises steel.

7. The swimming pool deck of claim 1, wherein deck inner edge has a height above a waterline of the swimming pool that is no larger than 1 inch.

8. The swimming pool deck of claim 7, further comprising a low-profile pool skimmer.

9. The swimming pool deck of claim 8, wherein upslope pool deck section further comprises a deck skimmer section above the low-profile pool skimmer.

10. The swimming pool deck of claim 9, wherein the deck skimmer section comprises a level deck skimmer section, wherein the level deck skimmer section has a flat elevation.

* * * * *